United States Patent [19]

Ueno

[11] 3,938,349

[45] Feb. 17, 1976

[54] REFRIGERATING APPARATUS WITH SUPERHEAT CONTROL

[75] Inventor: Takeo Ueno, Sennan, Japan

[73] Assignee: Daikin Kogyo Co., Ltd., Osaka, Japan

[22] Filed: Sept. 5, 1974

[21] Appl. No.: 503,507

[30] Foreign Application Priority Data

Sept. 21, 1973 Japan ..... 48-107206
Sept. 21, 1973 Japan ..... 48-107207

[52] U.S. Cl. ..... 62/197; 62/225; 62/324; 62/503

[51] Int. Cl.[2] ..... F25B 13/00

[58] Field of Search ..... 62/197, 225, 324, 503

[56] References Cited

UNITED STATES PATENTS 3,552,140 1/1971 Palmer ..... 62/324

3,779,031 12/1973 Akiyama et al. ..... 62/324 X

*Primary Examiner*—William E. Wayner

*Attorney, Agent, or Firm*—Cushman, Darby & Cushman

[57] ABSTRACT

An improved refrigeration system including a pilot heat exchanger so mounted as to bypass an accumulator and in which heat exchange takes place between a portion of low pressure refrigerant and refrigerant under high pressure so as to superheat the low pressure refrigerant, said heated refrigerant thereafter being returned to the compressor. The amount of superheating is sensed to control the expansion valve opening.

12 Claims, 12 Drawing Figures

→ HEATING CYCLE
---→ COOLING CYCLE

REFRIGERATING APPARATUS WITH SUPERHEAT CONTROL

Heretofore, various proposals have been made and some of them have been put to practical use in the field of refrigerating apparatus to provide a refrigerant control device whereby the volume of a refrigerant in circulation can be controlled in accordance with changes in the load. In one typical device known in the art, the degree of superheating of the refrigerant in a gaseous state and under lower pressure at the outlet of the evaporator is detected and the degree of opening of the expansion valve is adjusted accordingly. In this device, the degree of opening of the expansion valve is increased when the load is high and the degree of superheating is also high, so that the volume of the refrigerant in circulation can be increased to cope with the increase in the load and the degree of superheating can be lowered to a predetermined level.

The reason why the refrigerant under lower pressure is superheated at the outlet of the evaporator in this device is because the compressor would be damaged if the refrigerant in a liquid state were drawn by suction into the compressor without being changed to a perfect gaseous state in the evaporator by heat exchange due to a change in the load. Thus, in the device of the prior art, all the refrigerant under lower pressure which is changed to a perfect gaseous state passes through the cooling tube at the outlet side of the evaporator to superheat the same, so that the superheated refrigerant in a gaseous state can be returned to the compressor. The cooling tube section has a very low thermal-transmittance and performs no vaporization action, so that it does not function as a heat exchanger. Full utilization of the heat transfer area of the evaporator for performing a vaporization action has been hampered by the existence of the cooling tube which performs the sole function of superheating the refrigerant without vaporizing the same. The use of the cooling tube entails an increase in the size of the evaporator. In the case of a refrigerating machine which performs the functions of both cooling and heating, the member acting as a condenser when a cooling operation is performed is used as an evaporator when a heating operation is performed. In this type of refrigerating machines, the aforementioned refrigerant control device has an additional disadvantage of increasing the installation cost.

When the refrigerant drawn by suction into the compressor is in a superheated gaseous state, the refrigerating machine oil contained in the refrigerant tends to separate itself from the refrigerant and stagnate in the evaporator, so that the oil is not readily returned to the compressor and the compressor has many troubles. Because of this, it has hitherto been necessary to provide oil return means of special construction. Moreover, since the refrigerant drawn by suction into the compressor is in a superheated gaseous state, the refrigerant in a gaseous state introduced into the compressor is low in concentration. This has raised many problems. First of all, this not only lowers the coefficient of performance after all but also makes it necessary to increase the size of the evaporator because the evaporator has a low coefficient of heat transmission as aforementioned. When the machine performs a heating operation, frost tends to be formed because the refrigerant drawn by suction into the compressor is reduced in pressure. Last but not least important is the fact that the effective temperature range of the machine is narrowed when there are changes in load.

In another type of control device known in the art, the degree of supercooling of the refrigerant at the outlet of the condenser is controlled to thereby control the capabilities of the evaporator, so that the introduction of the refrigerant in a liquid state into the compressor can be prevented. The refrigerant at the outlet of the evaporator is in a superheated gaseous state when the load is high and in a state of mixture of gas and liquid when the load is low. The degree of supercooling of the refrigerant at the outlet of the condenser is changed when there are changes in the load. Thus, this control device is unable to effect control of the volume of the refrigerant in a stable manner because control is effected only indirectly with respect to changes in the load applied to the evaporator. Also, to supercool the refrigerant at the outlet of the condenser makes it necessary to accumulate the refrigerant at the outlet of the condenser, thereby increasing the charge of the refrigerant.

This invention has been invented for the purpose of providing a novel refrigerating apparatus which can cope admirably with the aforementioned facts and eliminate all the drawbacks of the refrigerating apparatus of the type described of the prior art.

Accordingly, a first object of the invention is to provide a refrigerating apparatus in which the volume of a refrigerant in circulation can be adjusted in accordance with changes in the load and the evaporator can be made to operate in humid condition at all times so that the total heat transfer area of the evaporator may be utilized for vaporization of the refrigerant in a liquid state and the size of the evaporator can be reduced to thereby reduce the overall cost of the apparatus, and in which the humid refrigerant under lower pressure can be heated and completely vaporized by the refrigerant under higher pressure in the accumulator so that the refrigerant may be changed to a gaseous state, whereby no refrigerant in a liquid state is drawn by suction into the compressor.

A second object of the invention is to provide a refrigerating apparatus in which a pilot heat exchanger serving as a detector is provided at the outlet of the evaporator and disposed in parallel with the accumulator to function as control means for permitting the evaporator to operate in humid condition at all times regardless of changes in the load, and in which a portion of the refrigerant under lower pressure is introduced from the outlet of the evaporator by bypassing the accumulator into the pilot heat exchanger where such portion of the refrigerant is brought into heat exchange relationship with other heat source and changed into a superheated gas whose degree of superheating is detected so as to adjust the degree of opening of the expansion valve in accordance with the detected degree of superheating, whereby the volume of the refrigerant in circulation can be controlled to permit the evaporator to operate in humid contition at all times.

A third object of the invention is to provide a refrigerating apparatus of the type described in which the portion of the refrigerant under lower pressure introduced into the pilot heat exchanger by bypassing the accumulator can be maintained in a predetermined ratio in volume with respect to all the refrigerant under lower pressure irrespective of changes in the load, whereby the degree of precision which control is effected can be increased and the machine can be operated in a stable manner because the expansion valve is free from hunting.

A fourth object of the invention is to provide a refrigerating apparatus which is provided with means for adjusting the liquid level of the refrigerant in the accumulator in order to keep constant the heat transfer rate of the heater provided in the accumulator and utilizing the refrigerant under higher pressure so that the refrigerant in a liquid state may not be drawn by suction into the compressor because of the fact that the evaporator operates in humid condition at all times irrespective of changes in the load.

A fifth object of the invention is to provide a refrigerating apparatus in which, in spite of the fact that the refrigerating apparatus operates in a reversible refrigerating cycle, the control of the refrigerant can be effected by a single expansion valve due to using four-way change-over means.

In addition, it should be noted that the term "operation of the evaporator in humid condition" used throughout the specification refers to an operation of the evaporator with the refrigerant at an outlet thereof being in an unsaturated gaseous state, i.e. in a state of mixture of gas and liquid.

Figure 6:
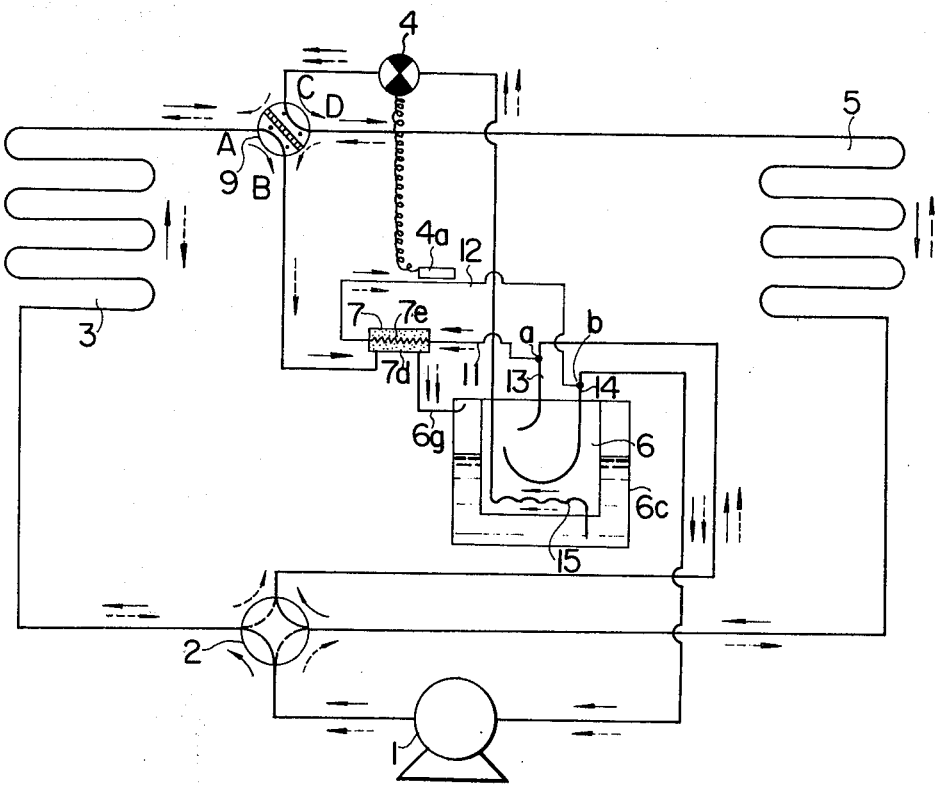
FIG. 6 is a piping diagram of the refrigerating apparatus comprising still another embodiment of the invention.
Figure 7:
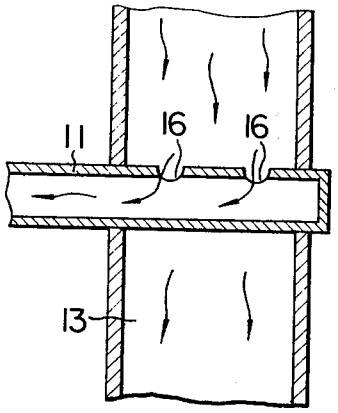
FIG. 7 is a sectional view, on an enlarged scale, of the branching portion of the inlet pipe of the pilot heat exchanger shown in FIG. 6.
Figure 9A:
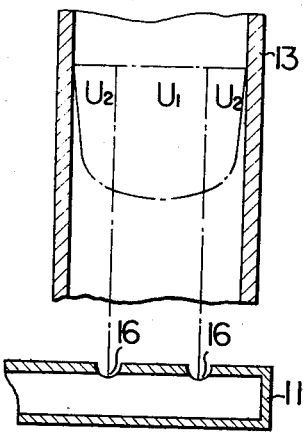
Figure 9B:
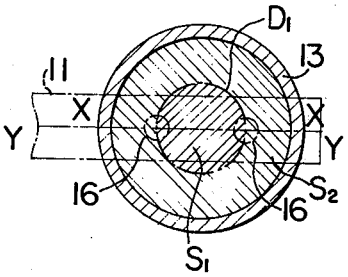
Figure 10:
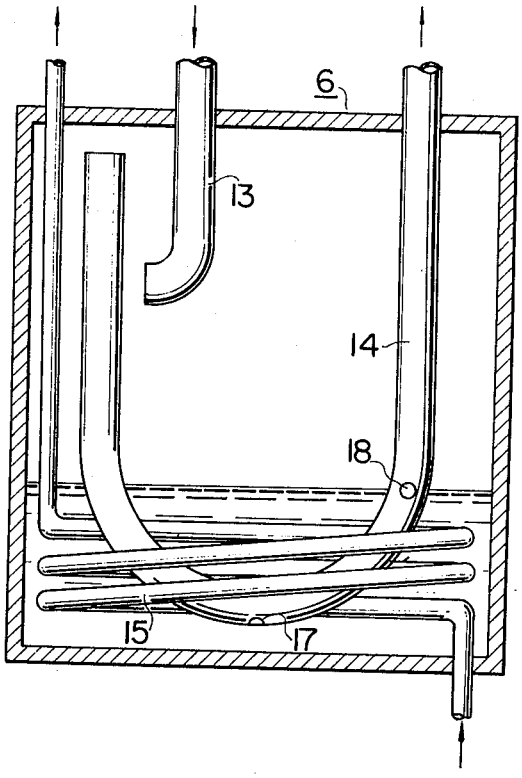
Figure 11:
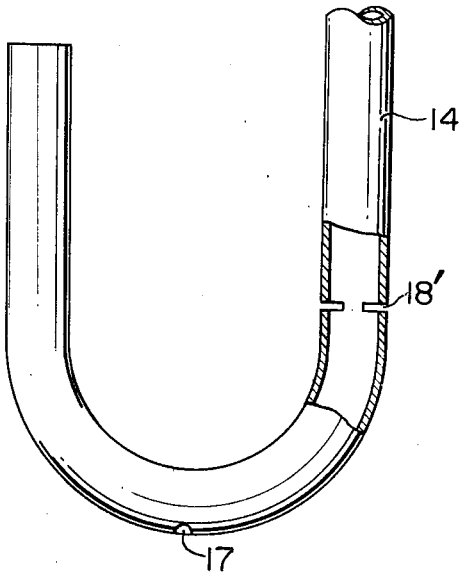

FIG. 9(*a*) and FIG. 9(*b*) are views in explanation of the essential portions shown in FIG. 7;

FIG. 10 is a schematic view, on an enlarged scale, of the accumulator of the refrigerating apparatus shown in FIG. 6; and FIG. 11 is a schematic view of another form of outlet pipe shown in FIG. 10.

Figure 1:
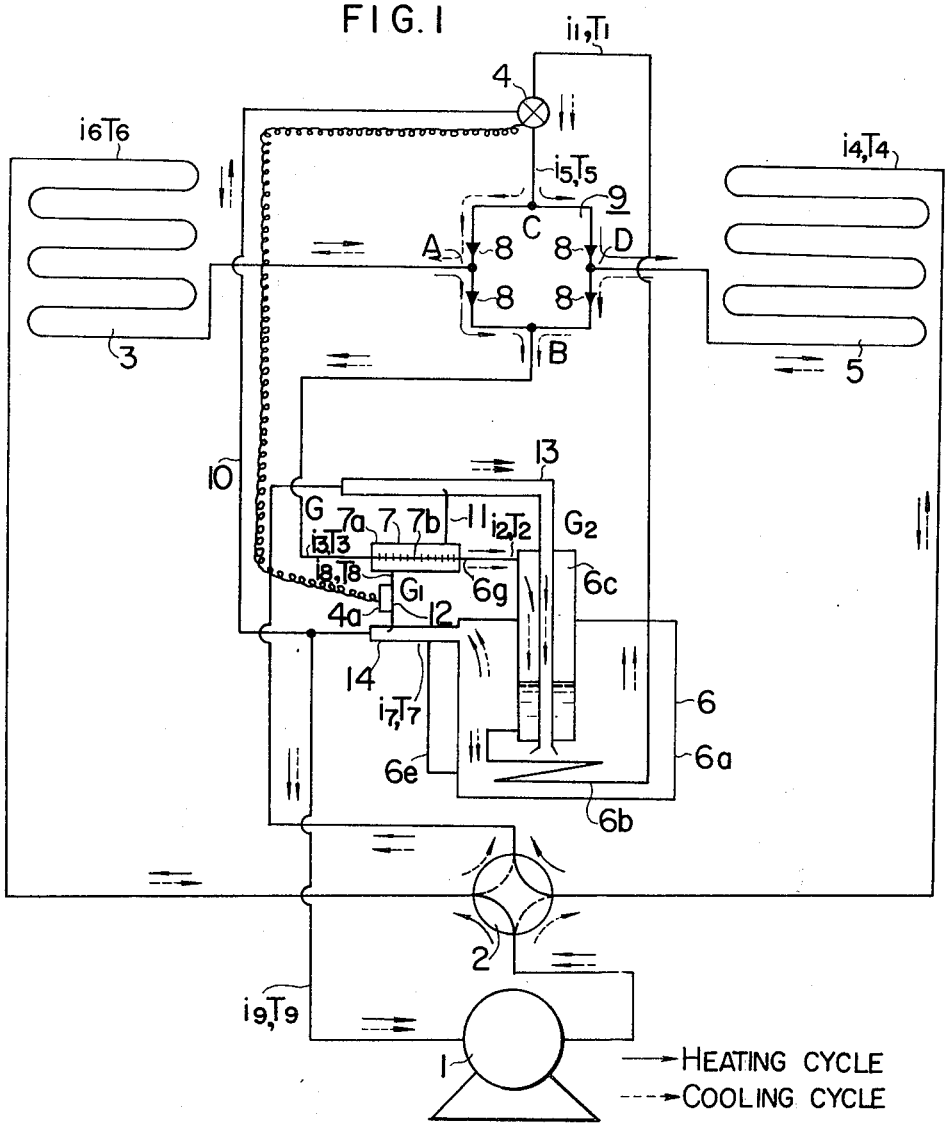
FIG. 1 is a piping diagram of the refrigerating apparatus comprising one embodiment of the invention.

The invention will now be described in detail with reference to the embodiments shown in the accompanying drawings. FIG. 1 shows a cooling and heating system of the compression refrigeration type which comprises a compressor 1, a four-way change-over valve 2, an outdoor heat exchanger 5 (hereinafter referred to as an outdoor coil), a receiver 6*c*, an automatic expansion valve of the temperature responsive type 4 (hereinafter referred to as an expansion valve), a room heat exchanger 3 (hereinafter referred to as a room coil), and an accumulator of the thermal exchanger type 6 (hereinafter referred to as an accumulator). The aforementioned parts are connected together in the indicated order to constitute a refrigeration circuit which is known. A pilot heat exchanger 7 and four-way change-over means 9 which are characterizing features of the invention are inserted in the known refrigeration circuit to form a refrigeration circuit shown in the figure.

Upon actuation of the four-way change-over valve 2, the compressor 1 is connected at its outlet side either to the outdoor coil 5 or the room coil 3 acting as a condenser, and the accumulator 6 is connected at its inlet side either to the room coil 3 or the outdoor coil 5 acting as an evaporator.

The four-way change-over means 9 comprises four check valves 8, 8, 8 and 8 connected together to form a bridge circuit. Ends A and D of a pair of opposed connecting pipes are connected to an end of the room coil 3 on a side thereof opposite the four-way change-over valve 2 and to an end of the outdoor coil 5 on a side thereof opposite the four-way change-over valve 2, respectively. Ends C and B of another pair of opposed connecting pipes are connected to an outlet of the expansion valve 4 and to an inlet of a finned tube 7*b* serving as a higher pressure side refrigerant passageway in the pilot heat exchanger 7, respectively. Thus, a refrigerant flowing in a stream through the expansion valve 4, pilot heat exchanger 7 and accumulator 6 flows in a predetermined direction at all times, even if the direction of flow of the steam of refrigerant through the room coil 3 and outdoor coil 5 when a cooling operation is perfomed is reversed from the direction of flow thereof when a heating operation is performed.

Figure 2:
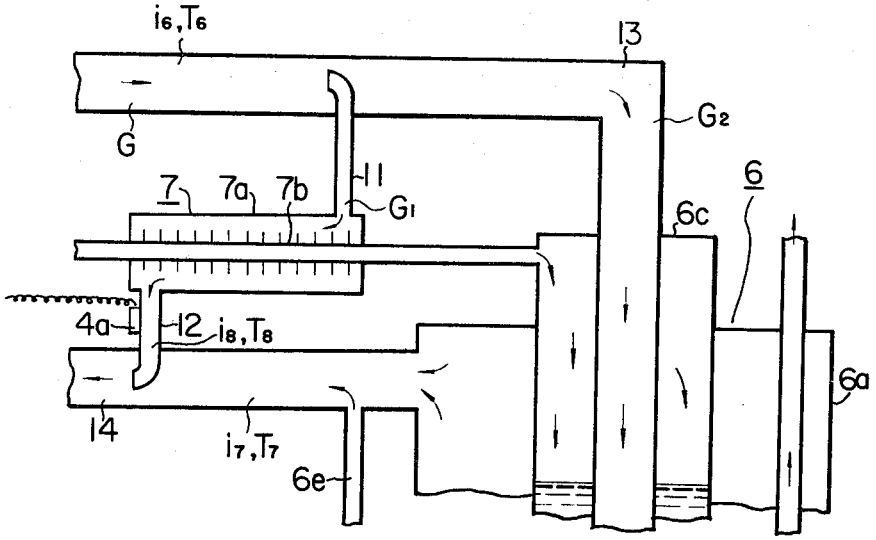
FIG. 2 is a detailed schematic view of the essential portions of the refrigerating apparatus shown in FIG. 1.

FIG. 2 shows, on an enlarged scale, the accumulator 6 and pilot heat exchanger 7. The accumulator 6 comprises a main body 6a serving as a lower pressure side refrigerant passageway, a heat exchange coil 6*b* (See FIG. 1) arranged transversely in a lower portion of the main body 6*a*, and a receiver 6*c* serving as a higher pressure side refrigerant passageway and inserted in airtight relation from above into the main body 6*a* to be disposed above the heat exchange coil 6*b*. The main body 6*a* has an outlet pipe 14 projecting from the upper portion of its side wall and an oil return pipe 6*e* projecting from the lower portion thereof, the oil return pipe 6*e* being connected to the outlet pipe 14 outside the main body 6*a*. On the other hand, an inlet pipe 13 extends through the receiver 6*c* and has an opening at its lower end which is disposed above the heat exchange coil 6*b*, and the receiver 6*c* is connected at its lower portion to the heat exchange coil 6*b* at its upper end. The heat exchange coil 6*b* is connected at its lower end to the expansion valve 4 at its inlet, and the inlet pipe 13 is connected to the four-way change-over valve 2. The outlet pipe 14 is connected to the suction side of the compressor 1 directly and to the expansion valve 4 through an equalizing pipe 10 (See FIG. 1).

The pilot heat exchanger 7, which is one of the features of the invention, comprises a main body 7*a* connected to the inlet pipe 13 through a minor diameter inlet pipe 11 and to the outlet pipe 14 through a minor diameter outlet pipe 12, so that the pilot heat exchanger 7 consitututes a bypass with respect to the accumulator 6. The pilot heat exchanger 7 further comprises a finned tube 7*b* disposed in the main body 7*a* to extend therethrough along its longitudinal axis and interposed between the connecting pipe end B and the upper portion of the receiver 6*c*, so that heat exchange can take place between the refrigerant under lower pressure passing through the main body 7*a* and the refrigerant under higher pressure passing through the finned tube 7*b*.

The expansion valve 4 has a temperature sensing member 4a mounted in the minor diameter outlet pipe 12 and serving as a control temperature detecting element. The member 4*a* detects the temperature of the refrigerant in a gaseous state and under lower pressure that has been subjected to heat exchange with the refrigerant under higher pressure at the pilot heat exchanger 7, and permits the degree of opening of the expansion valve 4 to be automatically adjusted accordingly.

The operation of the cooling and heating system constructed as aforementioned will now be described. In a cooling cycle indicated by broken line arrows, a suitable refrigerant in a gaseous state and under higher pressure is discharged from the compressor 1 and passes through the four-way change-over valve 2 to the outdoor coil 5 which functions as a condenser. At the outdoor coil 5, the major portion of the refrigerant is changed to a liquid state so that the refrigerant may have a dryness X which is ÷0.05, for example. When X=1, the refrigerant is in a dry saturated gaseous state; when X=0, it is in a saturated liquid state.

Then, the refrigerant in a liquid state passes through the connecting pipe ends D and B into the finned tube 7*b* of the pilot heat exchanger 7 where it is cooled by heat exchange taking place between it and a portion of the refrigerant moving as a branch stream through the main body 7*a* after passing through the room coil 3 functioning as an evaporator. The cooled refrigerant is introduced into the receiver 6*c*.

The cooled refrigerant is then subjected to further heat exchange at the heat exchange coil 6*b* in which is scattered the humid refrigerant disposed at the outlet of the room coil 3 functioning as an evaporator, so that it is changed to a supercooled refrigerant in a liquid state. The supercooled refrigerant in a liquid state passes through the expansion valve 4 and the connecting pipe ends C and A into the room coil 3.

At the room coil 3, the supercooled refrigerant in a liquid state is subjected to heat exchange with the air in the room, so that it vaporizes and becomes a saturated refrigerant which may have a dryness X÷0.85, for example. The saturated refrigerant passes through the four-way change-over valve 2 and the major portion thereof is introduced into the main body 6*a* of the accumulator 6 through the inlet pipe 13. At the same time, a minor portion of the saturated refrigerant passes through the minor diameter inlet pipe 11 into the main body 7*a* of the pilot heat exchanger 7. The major portion of the saturated refrigerant passing through the inlet pipe 13 serving as a heat exchange line is subjected to heat exchange with the supercooled refrigerant in a liquid state and under higher pressure in the receiver 6*c*, and scattered on to the heat exchange coil 6*b* with which it is subjected to further heat exchange. Thus, the saturated refrigerant having a dryness X=0.85 is changed back to a refrigerant in a dry saturated gaseous state having a dryness X=1.

On the other hand, the portion of the refrigerant under lower pressure passing through the minor diameter inlet pipe 11 into the pilot heat exchanger 7 is superheated, as aforementioned, by the refrigerant disposed in the outlet of the condenser (outdoor coil 5) and flowing through the finned tube 7*b*.

The saturated gas discharged from the accumulator 6 is mixed with oil passing through the oil return pipe 6*e*, and combined at the outlet line 14 with the superheated gas discharged from the pilot heat exchanger 7. Thus, the gas is returned to the suction side of the compressor 1, thereby completing a cooling cycle.

The aforementioned cycle is repeated. As an additional feature of the invention, the degree to which a portion of the refrigerant disposed at the outlet of the evaporator is superheated in the pilot heat exchanger 7 is detected by the temperature sensing member 4*a* mounted in the minor diameter outlet pipe 12. The member 4*a* produces a control signal which adjusts the degree of opening of the expansion valve 4, so that the room coil 3 functioning as an evaporator can operate in humid condition at all times and the efficiency of the system can be increased. The manner in which control of the expansion valve is effected is subsequently to be described in detail.

A heating cycle will now be described. By switching the four-way change-over valve 2 from the cooling cycle to the heating cycle, the refrigerant follows a path of movement indicated by solid line arrows. It is to be noted that, in the heating cycle, the refrigerant passes through the expansion valve 4, accumulator 6 and pilot heat exchanger 7 in the same direction as in the cooling cycle, and that the refrigerant is controlled and heat exchange is carried out in the same manner as aforementioned, except for the fact that the refrigerant passes through the outdoor coil 5 and room coil 3 in the opposite direction so that the former functions as an evaporator and the latter functions as a condenser.

Figure 3:
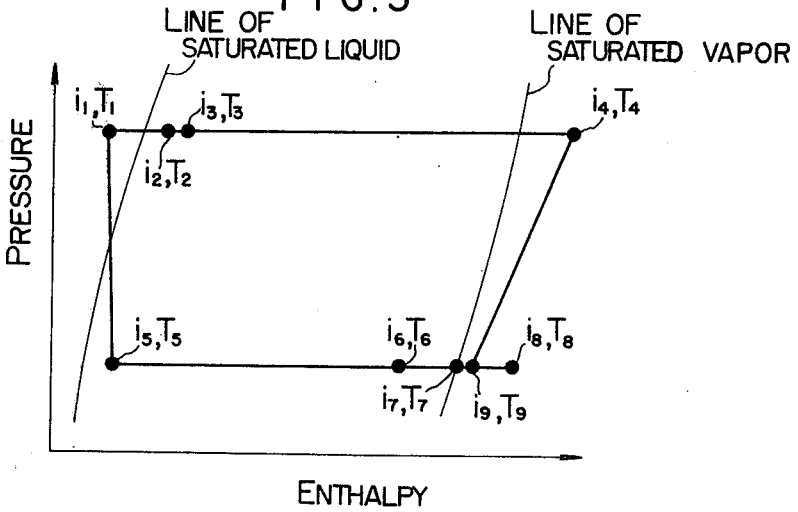
FIG. 3 is a Mollier diagram in explanation of the performance of the refrigerating apparatus shown in FIG. 1.

The flow and action of the refrigerant in the cooling cycle and heating cycle have been described above. By taking the cooling cycle as an example, the process of controlling the dryness X of the refrigerant disposed at the outlet of the room coil 3 functioning as an evaporator and maintaining the same at a predetermined level, say at a level where X=0.85, regardless of changes in the load will now be described in detail with reference to the Mollier diagram shown in FIG. 3. The total volume G of the refrigerant in circulation in a refrigeration circuit can be given by $$G = G_1 + G_2$$

where $G_1$ is the volume of the circulating refrigerant under lower pressure passing through the pilot heat exchanger 7, and $G_2$ is the volume of the circulating refrigerant under lower pressure introduced into the accumulator. The ratio of $G_1$ to $G_2$ is set such that $G_1:G_2 = 1:10$ to $1:20$.

Heat exchange takes place at the heat exchange coil 6b between the refrigerant under lower pressure $i_6$ disposed at the outlet of the room coil 3 and having a dryness X=0.85 and the refrigerant under higher pressure $i_2$ disposed at the outlet of the tube 7*b* of the pilot heat exchanger 7 and having a dryness X=0.05. When the heat exchange takes place, the heat balance can be given by $$G(i_2 - i_1) = G_2 (i_7 - i_6)$$

where X is the dryness of the refrigerant, $i_1$ is the enthalpy of the refrigerant about to be introduced into the expansion valve 4, $i_2$ is the enthalpy of the refrigerant disposed at the outlet of the pilot heat exchanger 7 or the inlet of the receiver 6*c*, $i_6$ is the enthalpy of the refrigerant disposed at the outlet of the room coil 3, and $i_7$ is the enthalpy of the refrigerant disposed in the outlet pipe 14 of the accumulator 6.

By suitably selecting the amount of heat exchanged in the accumulator 6, it is possible to bring the refrigerant to a dry saturated gaseous state (X=1).

Let us now consider the giving and receiving of heat by the refrigerant in the pilot heat exchanger 7. When heat exchange takes place between a portion $G_1$, $i_6$ of the refrigerant under lower pressure and the refrigerant G, $i_3$ disposed at the outlet of the outdoor coil 5 functioning as a condenser, the heat exchange balance can be given by $$G\ (i_3 - i_2) = G_1\ (i_8 - i_6)$$

where $i_3$ is the enthalpy of the refrigerant disposed at the outlet of the outdoor coil 5 functioning as a condenser or at the inlet of the finned tube 7*b* of the pilot heat exchanger 7, and $i_8$ is the enthalpy of the refrigerant disposed in the minor diameter outlet pipe 12.

By selecting a suitable size for the pilot heat exchanger 7 based on this heat balance, the degree of superheating ($T_8 - T_7$) of the refrigerant passing through the minor diameter outlet pipe 12 of the pilot heat exchanger 7 can be readily set at about 5°C. $T_8$ is the temperature of the refrigerant in the minor diameter outlet pipe 12 of the pilot heat exchanger 7, and $T_7$ is that of the refrigerant in the outlet pipe 14 of the accumulator 6.

Let us now consider the gas drawn by suction into the compressor 1. The gas $G.i_9$ drawn by suction into the compressor is a mixture of the superheated refrigerant $G_1.i_8$ disposed in the minor diameter outlet pipe 12 of the pilot heat exchanger 7 and the saturated refrigerant $G_2.i_7$ disposed in the outlet pipe 14 of the accumulator 6. since $G_1:G_2=1;10$ to $1:20$ and $G_1$ is smaller in volume than $G_2$ as aforementioned, the gas drawn by suction into the compressor 1 might as well be considered to be substantially in a saturated gaseous state.

As aforesaid, the expansion valve 4 for adjusting the volume of the refrigerant circulating through the refrigeration circuit is controlled by the temperature sensing member 4*a* adapted to sense the temperature of the refrigerant under lower pressure $i_8$ disposed at the outlet of the pilot heat exchanger 7.

If the load applied to the room coil 3 becomes higher and the enthalpy of the refrigerant $i_6$ at the outlet of the room coil 3 becomes greater, then the enthalpy of the refrigerant $i_8$ disposed at the outlet of the pilot heat exchanger 7 also becomes greater. Accordingly, the degree of superheating of the refrigerant also rises. The temperature sensing member 4*a* senses this and produces a signal to increase the degree of opening of the expansion valve 4 so as to increase the rate of flow of the refrigerant. This reduces the enthalpy of the refrigerant at the outlet of the room coil 3, which results in a reduction of the enthalpy of the refrigerant at the outlet of the pilot heat exchanger 7, thereby restoring the degree of superheating of the refrigerant to the predetermined level (5°C). Conversely, if the load applied to the room coil 3 becomes lower, then the enthalpy of the refrigerant $i_6$ at the outlet of the coil 3 becomes smaller and hence the enthalpy of the refrigerant at the outlet of the pilot heat exchanger 7 becomes smaller. As a result, the degree of superheating of the refrigerant at the outlet of the pilot heat exchanger 7 becomes smaller, so that the degree of opening of the expansion valve is reduced and the degree of superheating of the refrigerant can be maintained at 5°C.

In the aforementioned control system, the portion of the refrigerant having a dryness $X = 0.85$ and disposed at the outlet of the room coil 3 functioning as an evaporator is brought, at the pilot heat exchanger 7, into heat exchange relationship with the refrigerant disposed at the outlet of the outdoor coil 5 functioning as a condenser, and the expansion valve 4 can be controlled by using the temperature of the superheated refrigerant under lower pressure as an element to be detected, whereby the volume of the refrigerant in circulation passing through the expansion valve can be controlled. This control system has the effect of maintaining the dryness of the refrigerant disposed at the outlet of the room coil 3 functioning as an evaporator at a level such that the refrigerant is in a saturated gaseous state and has a suitable humidity at all times regardless of changes in the load applied to the evaporator. This makes it possible to make full use of the heat transfer area of the room coil functioning as an evaporator because vaporization of the refrigerant takes place in all the area of the coil.

In this control system, the refrigerant disposed at the outlet of the outdoor coil 5 functioning as a condenser can also be made into a flash gas state. Thus, effective use can be made of the heat transfer area of the outdoor coil 5.

In the aforementioned description, the outdoor coil 5 functions as a condenser and the room coil 3 functions as an evaporator. It is to be understood that the control system can achieve the same effect when the four-way change-over valve 2 is actuated such that the room coil 3 functions as a condenser and the outdoor coil 5 functions as an evaporator. The provision of the four-way change-over means 9 according to the invention offers an advantage in that control can be effected by using only one expansion valve in a refrigerating apparatus of the reversible refrigeration cycle.

In the aforementioned control system, the difference in temperature between the refrigerant at the inlet of the pilot heat exchanger 7 and the refrigerant at the outlet thereof can be detected as an electric change which can be converted into a mechanical displacement, so that the flow rate of the refrigerant can be controlled.

In the embodiment described above, the refrigerant under higher pressure disposed between the four-way change-over means 9 and the receiver 6 is used as a heat source for effecting heat exchange with a portion of the refrigerant under lower pressure. It is to be understood that the invention is not limited to the aforementioned refrigerant under higher pressure and that any refrigerant under higher pressure disposed between the heat exchanger functioning as a condenser and the expansion valve 4 can be used as a heat source.

Figure 4:
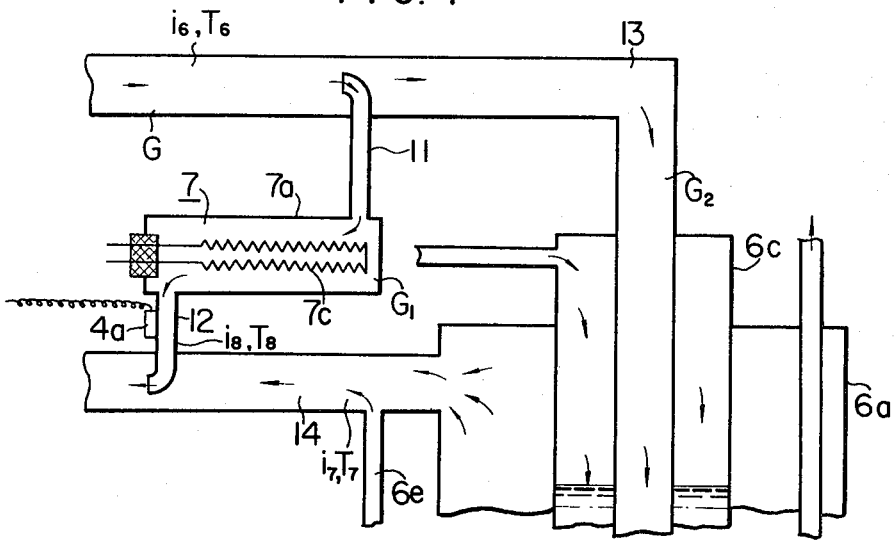
FIG. 4 is a detailed schematic view of the essential portions of the refrigerating apparatus comprising another embodiment of the invention.

FIG. 4 shows another embodiment of the invention in which the refrigerant under higher pressure is replaced by an electric heater 7*c* which is hermetically inserted in the pilot heat exchanger 7 to serve as a heat source for effecting heat exchange with a portion of the refrigerant under lower pressure disposed at the outlet of the room coil 3. In this embodiment, heat exchange takes place between the refrigerant under lower pressure flowing through the main body 7*a* and the heat generated by the electric heater 7*c*. Detailed description of this embodiment will be omitted because the embodiment differs from the embodiment shown in FIG. 2 in the following point only.

Figure 5:
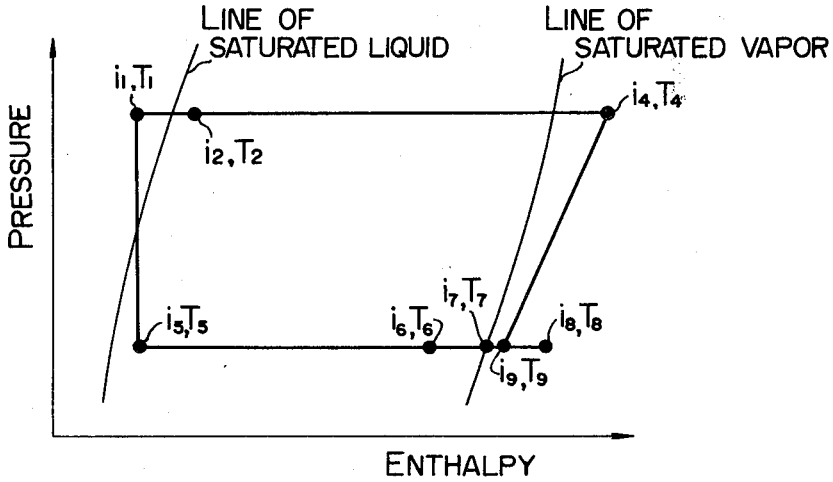
FIG. 5 is a Mollier diagram in explanation of the performance of the refrigerating apparatus shown in FIG. 4.

More specifically, in the embodiment shown in FIG. 4, heat exchange takes place between the portion of the refrigerant under lower pressure ($G_1.i_6$) and the heat generated by the electric heater 7*c*. The capacity Y (kw) of the electric heater 7*c* is given by $$Y = G_1\ (i_8 - i_6) \div 860$$

where $i_8$ is the enthalpy of the refrigerant in the minor diameter outlet pipe 12 of the pilot heat exchanger 7. FIG. 5 shows a Mollier diagram in explanation of this embodiment.

FIG. 6 shows still another embodiment of the invention in which the compressor 1, four-way change-over valve 2, outdoor coil 5, receiver 6*c*, expansion valve 4, room coil 3 and accumulator 6 are connected together in the indicated order to constitute a refrigeration circuit. Like the embodiment shown in FIG. 1, the embodiment shown in FIG. 6 further comprises, in addition to the known components of the refrigeration circuit, the pilot heat exchanger 7 and the four-way change-over means 9 which are characterizing features of the invention. The two embodiments differ from each other in the detailed construction of the four-way change-over means 9, pilot heat exchanger 7, receiver 6*c* and accumulator 6. The differences will presently be described.

The four-way change-over means 9 comprises two change-over ports A and D, one inlet port C and one outlet port B and constitutes a change-over valve which automatically connects the port A or D of the higher pressure to the outlet port B and the port D or A of the lower pressure to the inlet port C. The change-over port A is connected to the liquid line side of the room coil 3; the change-over port D is connected to the liquid line side of the outdoor coil 5; the outlet port B is connected, through the higher pressure side of the pilot heat exchanger 7, to the upper layer of the interior of the receiver 6*c*; and the inlet port C is connected to the outlet of the expansion valve 4. By this arrangement, it is possible to let the refrigerant to move in a constant flow direction through the pilot heat exchanger 7, receiver 6*c*, expansion valve 4 and accumulator 6, even if the direction of flow of the main stream of refrigerant in the refrigeration circuit is switched between the cooling cycle indicated by broken line arrows and the heating cycle indicated by solid line arrows.

The accumulator 6 is constructed integrally with the receiver 6*c*, with the former being hermetically housed in the latter with their top walls being disposed at the same level. A heat exchange coil 15 is disposed transversely in a lower portion of the accumulator 6 which is on the lower pressure side. The inlet pipe 13 connected to the four-way change-over valve 2 extends through the top wall of the accumulator 6 and opens in an upper portion of the accumulator 6, and the outlet pipe 14 connected to the suction side of the compressor 1 also extends through the top wall of the accumulator 6 into the accumulator where it is bent substantially in the form of a letter U, with the lower portion of the U-shaped outlet pipe 14 being immersed in the refrigerant in the liquid state disposed on the bottom of the accumulator and the upper open end of one leg of the letter U opening in the refrigerant in a gaseous state disposed in the upper portion of the accumulator 6.

On the other hand, if the receiver 6*c*, the inlet pipe 6*g* is connected to the higher pressure side of the pilot heat exchanger 7 as aforementioned and an outlet pipe opens at one end in a lower portion of the receiver 6*c* and is connected at the other end to the heat exchange coil 15 in the accumulator 6. The heat exchange coil 15 is connected to the inlet of the expansion valve 4 through a riser disposed along the side wall of the accumulator 6.

The pilot heat exchanger 7 which is compact in size may be constructed as a double wall tubular structure and comprise an outer tube 7*d* which permits all the refrigerant uner higher pressure disposed between the condenser and the receiver 6*c* to pass therethrough, and an inner tube 7*e* which permits a portion of the refrigerant under lower pressure to pass therethrough. The inner tube 7*e* is connected at its opposite ends to the minor diameter inlet pipe 11 and the minor diameter outlet pipe 12 to the inlet pipe 13 and the outlet pipe 14 of the accumulator 6 respectively, so that the minor diameter pipes bypass the accumulator. By this arrangement, heat exchange can take place in the pilot heat exchanger 7 between all the refrigerant under higher pressure which passes through the outer tube 7*d* and a portion of the refrigerant under lower pressure which passes through the inner tube 7*e*.

The temperature sensing member 4*a* for controlling the expansion valve 4 is mounted in the minor diameter outlet pipe 12 connected to the outlet pipe 14 and detects the degree of superheating of the refrigerant gas under lower pressure that has been subjected to heat exchange with the refrigerant under higher pressure in the pilot heat exchanger 7 so as to adjust the degree of opening of the expansion valve 4 accordingly.

Figure 8:
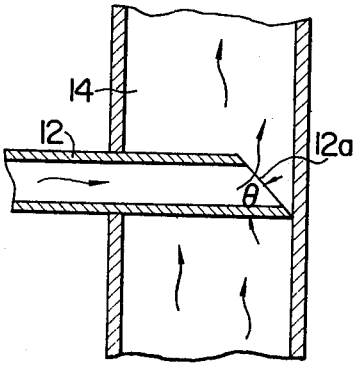
FIG. 8 is a sectional view, on an enlarged scale, of the branching portion of the outlet pipe of the pilot heat exchanger shown in FIG. 6.

An inlet portion *a* and an outlet portion *b* at which the minor diameter inlet pipe 11 and the minor diameter outlet pipe 12 are connected to the inlet pipe 13 and the outlet pipe 14 of the accumulator 6 respectively are shown in FIG. 7 and FIG. 8 on an enlarged scale. As shown, these portions each have a novel construction which is characteristic of the invention. Particularly, the inlet portion *a* is an outstanding feature of the invention. In the inlet portion *a*, the inlet pipe 13 is arranged vertically and the minor diameter inlet pipe 11 disposed normal to the longitudinal axis of the inlet pipe 13 is inserted at one end portion thereof in the inlet pipe 13 in right angle and airtight relationship in such a manner that, as shown in FIG. 9(*b*), the center line XX of a transverse sectional plane of the inlet pipe 13 coincides with the center line YY of a vertical sectional plane of the end portion of the minor diameter inlet pipe 11. The minor diameter inlet pipe 11 is closed at its front end and formed with at least two orifices 16, 16 in a portion of the wall of the pipe 11 which is disposed in the stream of refrigerant passing through the inlet pipe 13, so that a portion of the refrigerant under lower pressure passing through the inlet pipe 13 can be introduced through the orifices 16, 16 into the minor diameter inlet pipe 11 at a constant ratio with respect to all the refrigerant in circulation.

According to the invention, the positions of the orifices 16, 16 must meet a certain requirement. The requirement is that, when the orifices 16, 16 are two in number, they are formed at points at which the circumference of an imaginary circle $D_1$ intersects the longitudinal center axis of the minor diameter inlet pipe 11. In this case, the imaginary circle must be such that $U_1 \times S_1 = U_2 \times S_2$ where $S_1$ is the area inside the imaginary circle $D_1$, $S_2$ is the area outside the imaginary line $D_1$ [See FIG. 9(*b*)], $U_1$ is the integral value of the flow rate of the refrigerant inside the imaginary circle $D_1$ and $U_2$ is the integral value of the refrigerant outside the imaginary circle $D_1$ [See FIG. 9(*a*)].

This requirement for positioning the orifices must be met not only when the orifices are two in number as aforementioned but also when they are more than two in number. It is to be understood that when the orifices are formed based on the aforementioned principle the orifices are disposed on the circumference or circumferences of an odd numbered imaginary circle or circles.

By forming at least two orifices in the wall of the minor diameter inlet pipe 11 in accordance with the aforementioned principle, it is possible to introduce into the pilot heat exchanger 7 a refrigerant which is at a constant ratio in volume to all the refrigerant passing through the inlet pipe 13 of the accumulator 6, regardless of changes in the load. It is essential that the total sectional area of the orifices 16, 16 ... is smaller than the sectional area of the minor diameter inlet pipe 11 or the minor diameter outlet pipe 12.

As shown in FIG. 8, in the outlet portion *b*, the outlet port 14 is arranged perpendicularly in the refrigerating apparatus as is the case with the inlet pipe 13, and the minor diameter outlet pipe 12 disposed normal to the longitudinal axis of the outlet pipe 14 is hermetically inserted at one end portion thereof in the pipe 14 as is the case with the pipe 11. The end portion of the pipe 12 inserted in the pipe 14 is cut obliquely at its front end 12*a* such that the angle $\theta$ formed by the front end 12*a* and the wall of the pipe 12 is less than 45° or an acute angle so as to increase the area of opening of the pipe 12 in the pipe 14. The pipe 12 is disposed such that the oblique front end 12*a* faces the downstream side of the refrigerant passing through the outlet pipe 14.

When the inlet portion *a* and the outlet portion *b* of the pilot heat exchanger 7 is constructed as aforementioned, it is possible to disregard a change in the flow rate of the refrigerant due to a variation in the length of the minor diameter inlet pipe and minor diameter outlet pipe. Thus, the condition of the refrigerant in the pilot heat exchanger 7 can be detected with a high degree of precision and the refrigerating apparatus can be controlled positively as subsequently to be described.

The construction of the accumulator 6 is shown on an enlarged scale in FIG. 10. The lower portion of the U-shaped outlet pipe 14 is disposed below the heat exchange coil 15, and an oil return aperture 17 is formed at the bottom of the U-shaped outlet pipe 14. On the other hand, an orifice 18 is formed in one leg of the U-shaped outlet pipe 14 which is disposed on the refrigerant outlet side for the oil return aperture 17. The orifice 18 which is larger in dimension than the oil return aperture 17 is formed in a position such that it is disposed at the maximum level of the refrigerant in a liquid state.

The orifice 18 is formed in the form of a hole as shown in FIG. 10 but the outlet pipe 14 may have orifices 18' each which is formed in the form of a slit as shown in FIG. 11. The orifice 18 as well as the orifice 18' is formed in a portion of the wall of the pipe 14 which is disposed on the downstream side of the oil return aperture 17. It should be understood, however, that the orifice 18 or 18' may be provided on the upstream side of the oil return aperture 17. Other modifications will be apparent to one of ordinary skill in the art without departing from the scope and spirit of the invention.

The operation of the cooling and heating system constructed as aforementioned (FIG. 6 to FIG. 11) will now be described. The description of the operation which is similar to those of other embodiments (FIG. 1 to FIG. 5) will be omitted, and the description will be confined to the features of the embodiment shown in FIG. 6 to FIG. 11.

In the pilot heat exchanger of this embodiment, heat exchange takes place between the refrigerant under higher pressure passing through the outer tube 7*d* and the portion of the refrigerant under lower pressure passing through the inner tube 7*e* after being deflected from its course and prevented from entering the accumulator 6. As aforementioned with reference to the construction of the system, the inlet pipe 13 and the outlet pipe 14 of the accumulator 6 are arranged perpendicularly, and the orifices formed in the minor diameter inlet pipe 11 for introducing the refrigerant therethrough into the pilot heat exchanger 7 and the open end 12*a* of the minor diameter outlet pipe 12 through which the refrigerant is discharged from the pilot heat exchanger 7 each have a special construction. By virtue of these features, the refrigerant introduced into the inner tube 7*e* is uniform in state in cross-section when passing through the minor diameter inlet pipe, and the refrigerant drawn by suction into the minor diameter inlet pipe 11 branching off the inlet pipe 13 and connected to the pilot heat exchanger 7 is at a constant ratio in volume to all the refrigerant in circulation. The refrigerant is discharged through the outlet pipe 12 without any resistance being offered thereto. Thus, control of the refrigerant can be effected with a high degree of precision by detecting the degree of superheating of the refrigerant under lower pressure regardless of changes in the load.

The operation of the accumulator 6 will now be described. If the liquid level in the accumulator 6 rises above the orifice 18 as a result of a change in the load, then the refrigerant is drawn by suction in relatively large volumes through the oil return aperture 17 and the orifice 18 which is larger in dimension than the aperture 17. If the liquid level in the accumulator 6 falls below the orifice 18, then the refrigerant is drawn by suction in relatively small volumes through the oil return aperture 17 only.

However, the refrigerant in a liquid state drawn by suction through the oil return aperture 17 and the orifice 18 is very small in volume as compared with the refrigerant in a gaseous state drawn by suction through the U-shaped outlet pipe, so that the refrigerant in a liquid state is immediately converted into a gaseous state by the heat of the gas in the accumulator 6 as soon as it is drawn by suction through the U-shaped pipe. This entirely eliminates the hazard of the refrigerant in a liquid state being drawn by suction into the compressor 1.

Moreover, since the heat exchange coil 15 is immersed in the refrigerant in a liquid state at all times, the system has a constant heat transfer rate which is at a high level and the dry gas can be returned to the compressor in a stable manner. Thus, the refrigerating apparatus can be operated in a stable manner and with a high degree of efficiency.

Since the orifice 18 has a larger dimension than the oil return aperture 17 as aforementioned, the liquid level in the accumulator 6 can be controlled positively without being affected by the drawing of a mixture of oil and refrigerant by suction through the oil return aperture 17, and the oil can be returned satisfactorily to ensure smooth operation of the compressor 1 because the oil disposed on the liquid level can be returned. It is to be understood that the heat source for the accumulator 6 in this embodiment is not limited to the refrigerant under higher pressure passing through the heat exchange coil 15, and that an electric heater or other heat source may be used as is the case with the previously described embodiments.

The temperature sensing member 4a is mounted in the minor diameter outlet pipe 12 for producing a signal to adjust the degree of opening of the expansion valve 4, in order that the degree of superheating of a portion of the refrigerant in the room coil 3 can be set at a predetermined level by using the pilot heat exchanger in the same manner as in the embodiment shown in FIG. 1.

The features characteristic of the invention are as aforementioned. In the 1st aspect of the invention, the pilot heat exchanger 7 is mounted such that it constitutes a bypass of the accumulator so that heat exchange may take place between a portion of the refrigerant disposed at the outlet of the heat exchanger functioning as an evaporator and the refrigerant disposed at the outlet of the heat exchanger functioning as a condenser. The degree of opening of the expansion valve 4 is adjusted in accordance with the degree of superheating of the refrigerant under lower pressure disposed at the outlet of the pilot heat exchanger 7, whereby the evaporator can be made to function in humid condition at all times regardless of changes in the load. By this arrangement, the dryness of the refrigerant at the outlet of the evaporator can be set at a predetermined level at which about 85 percent of the refrigerant is converted into a gaseous state and about 15 percent thereof remains in a liquid state. The refrigerant in the humid state is brought to heat exchange relation with the refrigerant under higher pressure in the accumulator 6 so that the refrigerant drawn by suction into the compressor 1 may be converted into a saturated gas.

In the aforementioned control system of the prior art, all the refrigerant under lower pressure is superheated in the cooling tube on the outlet side of the evaporator. The cooling tube does not take part in vaporization of the refrigerant and therefore has a very low coefficient of heat transmission. This makes it impossible to make full use of the heat transfer area of the evaporator for vaporizing the refrigerant, and consequently the size of the evaporator is increased with an attendant increase in cost.

According to the invention, however, the evaporator operates in humid condition at all times regardless of changes in the load. This permits all the heat transfer area of the evaporator to be utilized for vaporizing the refrigerant in a liquid state, with a result that the coefficient of heat transmission of the evaporator is improved. Thus, the invention is conductive to higher capabilities of the apparatus when the heat exchange area remains the same and to reduced heat exchange area when the capabilities of the apparatus remain the same, thereby permitting to reduce cost.

The aforementioned control system of the prior art in which the refrigerant is superheated in the cooling tube on the exit side of the evaporator has an additional disadvantage. In this system, the portion of the superheated refrigerant increases or reduces in volume with changes in the load. This causes changes to occur in the coefficient of heat transmission of the evaporator. Thus, in this control system, control must be effected to cope with a change in the load and a change in the coefficient of heat transmission of the evaporator, so that difficulty is experienced in adjusting the degree of opening of the expansion valve.

In the present invention, control is effected such that the evaporator operates in a humid condition at all times regardless of changes in the load, and there is almost no change in the heat transfer area of the evaporator even if a change occurs in the load. Thus, the degree of opening of the expansion valve has only to be adjusted in accordance with a change in the load, because there is almost no change in the coefficient of heat transmission. The degree of opening of the expansion valve 4 is stabilized and the valve is free from the hunting phenomenon.

In the control system of the prior art, there are possibilities of troubles of the compressor 1 due to the lack of oil. This is because the refrigerating apparatus oil contained in the refrigerant tends to separate itself from the refrigerant and remain in the evaporator without returning to the compressor, since the refrigerant drawn by suction into the compressor 1 is in a superheated gaseous state. To overcome this disadvantage, it has hitherto been necessary to use additional means, such for example as oil return means, of special construction. According to the invention, the evaporator is made, as aforementioned, to operate in humid condition at all times regardless of changes in the load, so that separation of the refrigerating apparatus oil from the refrigerant and stagnation thereof in the evaporator can be prevented. As another feature of the invention, the oil return aperture 17 and the orifice 18 are formed in the outlet pipe 14 of the accumulator 6 to facilitate oil return to the compressor 1, thereby eliminating the need to provide oil return means of special construction.

According to the invention, the refrigerant in humid condition in the evaporator is heated and completely vaporized in the accumulator 6 into a dry saturated gas which is mixed at the outlet of the accumulator 6 with the refrigerant in a gaseous state which has been superheated in the pilot heat exchanger 7, so that the mixture is drawn by suction into the compressor. Since the superheated refrigerant in a gaseous state is very small in volume as compared with all the refrigerant in circulation, the refrigerant in a gaseous state drawn into the compressor 1 is not superheated and it is substantially in a saturated gaseous state.

When the conventional superheated gas suction system is incorporated in a refrigerating apparatus, it is almost impossible to operate the apparatus under overload because the compressor 1 tends to be damaged due to overheating of the compressor and electric motor. In the refrigerating apparatus according to the invention, there is little possibility of the electric motor being overheated because the dry saturated gas is drawn into the compressor 1, so that the apparatus can withstand operation under overload for a while. Since the refrigerant drawn into the compressor 1 is in a dry saturated gaseous state, it is higher in density than the refrigerant in a superheated gaseous state which is used in apparatuses of the prior art. Thus, the refrigerant gas drawn into the compressor 1 in the invention has a higher compression efficiency and therefore the compressor is higher in efficiency than compressors of the conventional apparatuses. This is conductive to increased coefficient of performance.

According to the invention, control of the evaporator is effected by the expansion valve 4 disposed immediately before the evaporator. This makes it possible to effect control in a stable manner by responding quickly to a change in the load.

The conventional system of adjusting the degree of supercooling of the refrigerant at the outlet of the condenser by detecting the state of the refrigerant at the outlet of the evaporator brought about by a change in the load may be said to effect indirect control, as compared with the system according to the invention in which the evaporator is directly controlled to cope with a change in the load applied to the evaporator. The conventional system is slow in responding to a change in the load. Moreover, there is the problem of the state of the refrigerant at the outlet of the evaporator undergoing a change, even if the degree of supercooling of the refrigerant at the outlet of the condenser is adjusted. Thus, the conventional supercooling system is unable to effect control in a stable manner. In the conventional supercooling system, the outlet of the condenser and the inlet of the expansion valve are sealed by the refrigerant in a supercooled liquid state. It is thus necessary to accumulate the refrigerant in a liquid state in the condenser. This is conductive to reduced capabilities and increased size of the condenser, and the charge of the refrigerant is increased accordingly.

In a refrigerating apparatus incorporating therein the control system according to the invention, the refrigerant at the outlet of the condenser can be controlled such that it is maintained in a flash gas state, because the refrigerant can be cooled in the pilot heat exchanger 7 and the accumulator 6. This makes it possible to make effective use of the heat transfer area of the condenser as well as the heat transfer area of the evaporator, so that it is possible to reduce the size of the condenser. Since no refrigerant in a liquid state is accumulated in the condenser, the charge of the refrigerant in the apparatus can be greatly reduced, thereby reducing the cost of the refrigerating apparatus.

Since no refrigerant in a liquid state is accumulated in the condenser, the pressure required for condensation of vapor is lower than in a refrigerating apparatus using the aforementioned conventional control system, so that the condenser can tolerate an application of an overload. Moreover, the refrigerant at the outlet of the evaporator is higher in pressure when the control system according to the invention is used than when the conventional superheated gas system is used, so that frost formation can be prevented. By virtue of these two features, the refrigerating apparatus according to the invention can be operated with a wider effective temperature range than has hitherto been possible.

The pilot heat exchanger 7 used in the control system which can achieve the aforementioned specific results has only to have a capacity large enough to superheat a portion of the refrigerant under lower pressure. Therefore, it is possible to use the pilot heat exchanger of a very small size and of very simple construction, such as a double tube structure, irrespective of the capacity of the refrigerating apparatus. This is conductive to reduced cost.

In the 2nd aspect of the invention, the refrigerant under higher pressure interposed between the heat exchanger functioning as a condenser and the expansion valve 4 may be used as a heat source with which a portion of the refrigerant under lower pressure is brought into heat exchange relationship in the pilot heat exchanger 7, and such refrigerant under higher pressure may be introduced into the heat exchanger 7 from any source as desired. The refrigerant coming out of the condenser can be changed to a saturated liquid state if it is a flash gas, and into a supercooled liquid state if it is in a saturated liquid state, by the heat exchange taking place in the pilot heat exchanger. Combined with the heat exchange taking place between the refrigerant under higher pressure and the refrigerant under lower pressure in the accumulator 6, this permits the refrigerant under higher pressure to be supplied to the evaporator after changing the refrigerant to a perfect liquid or supercooled liquid state. This is conductive to increased efficiency of the refrigerating apparatus.

In the 3rd aspect of the invention, a heat generating member other than the refrigerant under higher pressure can be used as a heat source for the heat exchanger. When this is the case, the heat source of the pilot heat exchanger has only to have a capacity large enough to heat a portion of the refrigerant disposed at the outlet of the evaporator. This means that such heat source has a small capacity and that the amount of heat generated by it can be adjusted readily. This makes it possible to effect control with a high degree of precision.

In the 4th aspect of the invention, the inlet pipe 13 connected to the pilot heat exchanger 7 branching off the inlet pipe 13 at the entrance to the accumulator 6 is formed therein with two or more orifices of even number which are disposed in positions such that a portion of the refrigerant which is at a constant ratio with respect to the refrigerant passing through the inlet pipe 13 can be deflected from its course and introduced into the pilot heat exchanger 7. By this arrangement, it is possible to cause the branch stream of refrigerant under lower pressure which is at a constant ratio in volume to the main stream of refrigerant under lower pressure to pass through the pilot heat exchanger 7 regardless of changes in the load or variations in the length of line to the pilot heat exchanger 7. Thus, control of capabilities of the apparatus can be effected in a stable manner without the expansion valve 4 suffering from hunting.

In the 5th aspect of the invention, the inlet pipe 13 of the accumulator 6 connected to an intake portion of the minor diameter inlet pipe connected to the pilot heat exchanger 7 is disposed perpendicularly in the refrigerating apparatus. By this arrangement, it is possible to take out the refrigerant in a state which remains constant even if the refrigerant is in a state of the mixture of gas and liquid (if the inlet pipe 13 were disposed horizontally, the refrigerant in a liquid state would move through the lower portion of the pipe and the refrigerant in the minor diameter inlet pipe 11 would vary in state from the refrigerant in the inlet pipe 13). The minor diameter outlet pipe 12 has an acute-angled end 12*a* which opens on the downstream side of the refrigerant passing through the outlet pipe 14. This permits the refrigerant to move out of the minor diameter outlet pipe 12 into the outlet pipe 14 with least resistance. Thus, control of capabilities of the apparatus can be effected in a stable manner.

In the 6th aspect of the invention, the outlet pipe 14 connecting the accumulator 6 to the compressor 1 is formed in the shape of a letter U, with the open end of one leg of the U-shaped pipe 14 being disposed in the refrigerant in a gaseous state in the accumulator 6 and the bottom portion of the U-shaped pipe 14 being disposed in the lower portion of the accumulator 6. The oil return aperture 17 is formed in the bent bottom portion of the U-shaped pipe 14, while the orifice 18 is formed in the other leg of the U-shaped pipe 14 in a position which is disposed above the heat exchange coil 15. This arrangement enables the evaporator disposed anterior to the accumulator 6 to operate such that the refrigerant at the outlet of the evaporator is in a state of humid saturated gas, so that all the heat transfer area of the evaporator can be utilized for performing a vaporization action. At the same time, it enables the refrigerant in a dry gaseous state to be returned to the compressor 1. Thus, the capabilities of the refrigerating apparatus can be maximized.

In the accumulator 6 in which the volume of refrigerant is adjusted and the refrigerant drawn by suction is heated, the orifice 18 is formed in the U-shaped outlet pipe 14 in a position which is disposed above the heat exchange coil 15. By this arrangement, it is possible to maintain the liquid level in the accumulator 6 at an optimum level at which the liquid level is high enough to enable the heat exchange coil 15 to be immersed in the refrigerant in a liquid state. Thus, the thermal conductivity of the heat exchange coil 15 can be improved and kept constant, and the refrigerating apparatus can be operated in a stable manner and with a high degree of efficiency.

In the 7th to 12th aspects of the invention, the refrigerating apparatus can be operated as a reversible apparatus of the heat pump type by mounting the four-way change-over valve 2 and the four-way change-over means 9 in the apparatus. According to the invention, the stream of refrigerant moving through the pilot heat exchanger 7, receiver 6*c*, expansion valve 4 and accumulator 6 can be controlled such that the refrigerant flows in the same direction, even if the refrigerant flows in one direction through the room coil and outdoor coil of the refrigeration circuit when the apparatus performs a cooling operation and flows in the opposite direction when it performs a heating operation. This eliminates the need to use an additional expansion valve and only one expansion valve 4 can do the job, thereby reducing cost. The outdoor coil 5 functioning as a condenser when the apparatus performs a cooling operation functions as an evaporator when the apparatus performs a heating operation. This permits to reduce the size of the outdoor coil without reducing its performance as a condenser, because control is effected such that no refrigerant in a liquid state is accumulated therein when it functions as a condenser in the cooling operation.

I claim:

1. A refrigerating apparatus comprising a refrigeration circuit in which a compressor, an outdoor heat exchanger, a receiver, a temperature sensing automatic expansion valve, a room heat exchanger and an accumulator are connected together in the indicated order, said receiver and said accumulator being capable of performing heat exchange; a pilot heat exchanger disposed in parallel with said accumulator and connected to said refrigeration circuit such that a portion of a refrigerant under lower pressure disposed at an outlet of said room heat exchanger functioning as an evaporator bypasses said accumulator and passes through said pilot heat exchanger where said portion of the refrigerant under lower pressure is subject to heat exchange with other heat source and then returned to the compressor after being combined with the refrigerant under lower pressure at an outlet of said accumulator; detection means mounted at an outlet of said pilot heat exchanger to detect the temperature of said one portion of the refrigerant under lower pressure at the outlet of said pilot heat exchanger before being combined with the refrigerant under lower pressure at the outlet of said accumulator, means connecting said expansion valve with said detection means so that the degree of opening of said expansion valve is adjusted in accordance with the degree of superheating of the refrigerant so as to adjust the volume of the refrigerant moving through the refrigeration circuit, whereby the room heat exchanger can be made to operate in humid condition at all times regardless of changes in the load and the humid refrigerant can be subjected to heat exchange with a refrigerant under higher pressure in said accumulator so as to return to said compressor of a refrigerant in a saturated gaseous state.

2. A refrigerating apparatus as claimed in claim 1 wherein said other heat source subjected in said pilot heat exchanger to heat exchanger with said one portion of the refrigerant under lower pressure disposed at the outlet of said room heat exchanger is a refrigerant under higher pressure moving through said refrigeration circuit, the refrigerant under higher pressure interposed between said outdoor heat exchanger and said expansion valve being made to pass through said pilot heat exchanger.

3. A refrigerating apparatus as claimed in claim 1 wherein said other heat source subjected in said pilot heat exchanger to heat exchange with said one portion of the refrigerant under lower pressure disposed at the outlet of said room heat exchanger is an electric heater or other heat source than the refrigerant circulating in the refrigerating apparatus, said the other heat source being mounted in said pilot heat exchanger.

4. A refrigerating apparatus as claimed in claim 1 further comprising an inlet pipe of said accumulator, a minor diameter inlet pipe branching off said inlet pipe and connected to said pilot heat exchanger, an outlet pipe of said accumulator, and a minor diameter outlet pipe connected at one end to said pilot heat exchanger and at the other end to said outlet pipe, so that said one portion of the refrigerant under lower pressure disposed at the outlet of said room heat exchanger and bypassing said accumulator is introduced into said pilot heat exchanger through said inlet pipe and said minor diameter inlet pipe and discharged therefrom through said minor diameter outlet pipe and said outlet pipe, said minor diameter inlet pipe having an intake portion which extends through said inlet pipe such that the center line of a transverse sectional plane of said inlet pipe coincides with the center line of a vertical sectional plane of said intake portion of said minor diameter inlet pipe, and wherein two or more orifices are formed in a portion of a wall of said intake portion of said minor diameter inlet pipe which is disposed on the upstream side of the refrigerant passing through said inlet pipe, said orifices being disposed on the circumference or circumferences of an odd-numbered imaginary circle or circles centered at the center of said transverse sectional plane of said inlet pipe and growing larger in diameter, said imaginary circle or circles being drawn such that the product of the value of integration of the flow rate of the refrigerant passing through a first imaginary circle and the sectional area of said first imaginary circle, the product of the value of integration of the flow rate of the refrigerant passing through the area interposed between the first imaginary circle and the second imaginary circle and the sectional area between the first imaginary circle and the second imaginary circle, and the product of the value of integration of the flow rate of the refrigerant passing through the area interposed between two circles having larger diameters and the sectional area between the adjacent two larger diameter circles are equal to one another.

5. A refrigerating apparatus as claimed in claim 4 wherein said inlet pipe of the accumulator through which the intake portion of said minor diameter inlet pipe extends is disposed vertically, and said minor diameter outlet pipe has a forward end portion extending through said outlet pipe of the accumulator, said forward end portion having an acute-angled end opening on the downstream side of the refrigerant passing through the outlet pipe of the accumulator.

6. A refrigerating apparatus as claimed in claim 1 further comprising a heat exchange coil disposed in a lower portion of said accumulator and forming a part of a line for delivering the refrigerant under higher pressure from said receiver to said expansion valve so that the refrigerant under lower pressure and in a liquid state in the accumulator can be heated and vaporized, and a U-shaped pipe forming a part of said outlet pipe of the accumulator connecting said accumulator to the compressor, said U-shaped pipe of the outlet pipe having an open forward end positioned in the refrigerant under lower pressure and in a gaseous state in the accumulator and a bent bottom portion immersed in the refrigerant under lower pressure and in a liquid state in a bottom of the accumulator, said U-shaped pipe of the outlet pipe further having an oil return aperture provided at said bent bottom portion thereof and an orifice provided in one leg thereof at a position which is above said heat exchange coil.

7. A refrigerating apparatus as claimed in claim 1 wherein said refrigeration circuit further comprises a four-way change-over valve, four-way change-over means, an inlet pipe of said accumulator and an inlet pipe of said receiver, said four-way change-over valve being operative to switch the delivery side of said compressor between the outdoor heat exchanger and the room heat exchanger each functioning as a condenser and also to switch said inlet pipe of the accumulator between the room heat exchanger and the outdoor heat exchanger each functioning as an evaporator, said four-way change-over means being operative to switch said inlet pipe of the receiver between the outdoor heat exchanger and the room heat exchanger each functioning as a condenser and also to switch said expansion valve between the room heat exchanger and the outdoor heat exchanger each functioning as an evaporator, whereby the refrigerating apparatus can be operated reversibly.

8. A refrigerating apparatus as claimed in claim 7 wherein said other heat source subjected in said pilot heat exchanger to heat exchange with said one portion of the refrigerant under lower pressure disposed at the outlet of said room heat exchanger or said outdoor heat exchanger functioning as an evaporator is a refrigerant under higher pressure, and said pilot heat exchanger is connected to said refrigeration circuit such that the refrigerant under higher pressure interposed between the outdoor heat exchanger or the room heat exchanger functioning as a condenser and the expansion valve passes through said pilot heat exchanger.

9. A heat exchanger as claimed in claim 7 wherein said other heat source subjected in said pilot heat exchanger to heat exchange with said one portion of the refrigerant under lower pressure disposed at the outlet of the room heat exchanger or the outdoor heat exchanger functioning as an evaporator is an electric heater or other heat source than the refrigerant circulating in the refrigerating apparatus, said the other heat source being mounted in said pilot heat exchanger.

10. Refrigerating apparatus as claimed in claim 7 further comprising a minor diameter inlet pipe branching off said inlet pipe of the accumulator and connected to said pilot heat exchanger, and a minor diameter outlet pipe connected at one end to said pilot heat exchanger and at the other end to said outlet pipe of the accumulator, so that said one portion of the refrigerant under lower pressure disposed at the outlet of the room heat exchanger or outdoor heat exchanger functioning as an evaporator and bypassing said accumulator is introduced into said pilot heat exchanger through said inlet pipe and said minor diameter inlet pipe and discharged therefrom through said minor diameter outlet pipe and said outlet pipe, said minor diameter inlet pipe having an intake portion which extends through said inlet pipe such that the center line of a transverse sectional plane of said inlet pipe coincides with the center line of a vertical sectional plane of said intake portion of said minor diameter inlet pipe, and wherein two or more orifices are formed in a portion of a wall of said intake portion of said minor diameter inlet pipe which is disposed on the upstream side of the refrigerant passing through said inlet pipe, said orifices being disposed on the circumference or circumferences of an odd-numbered imaginary circle or circles centered at the center of said transverse sectional plane of said inlet pipe and growing larger in diameter, said imaginary circle or circles being drawn such that the product of the value of integration of the flow rate of the refrigerant passing through a first imaginary circle and the sectional area of said first imaginary circle, the product of the value of integration of the flow rate of the refrigerant passing through the area interposed between the first imaginary circle and the second imaginary circle and the sectional area between the first imaginary circle and the second imaginary circle, and the product of the value of integration of the flow rate of the refrigerant passing through the area interposed between two circles having larger diameters and the sectional area between the adjacent two larger diameter circles are equal to one another.

11. A refrigerating apparatus as claimed in claim 7 further comprising a minor diameter inlet pipe connected at one end to said pilot heat exchanger and at the other end to said inlet pipe of said accumulator, and a minor diameter outlet pipe connected at one end to said pilot heat exchanger and at the other end to said outlet pipe of the accumulator, and wherein the outlet pipe of the accumulator is disposed vertically and an intake portion of said minor diameter inlet pipe extends through said inlet pipe, and the minor diameter outlet pipe has an end portion inserted in said outlet pipe of the accumulator and having an acute-angled end opening on the downstream side of the refrigerant passing through the outlet pipe.

12. A refrigerating apparatus as claimed in claim 7 further comprising a heat exchange coil disposed in a lower portion of said accumulator and forming a part of a line for delivering the refrigerant under higher pressure from said receiver to said expansion valve so that the refrigerant under lower pressure and in a liquid state in the accumulator can be heated and vaporized, and a U-shaped pipe forming a part of said outlet pipe of the accumulator connecting said accumulator to the compressor, said U-shaped pipe of the outlet pipe having an open forward end positioned in the refrigerant under lower pressure and in a gaseous state in the accumulator and a bent bottom portion immersed in the refrigerant under lower pressure and in a liquid state in a bottom of the accumulator, said U-shaped pipe of the outlet pipe further having an oil return aperture provided at said bent bottom portion thereof and an orifice provided in one leg thereof at a position which is above said heat exchange coil.

* * * * *